US005509372A

United States Patent [19]

Culotta

[11] Patent Number: 5,509,372

[45] Date of Patent: Apr. 23, 1996

[54] MULTIFEATURE SAFETY MOTOR CONTROL FOR DIVER PROPULSION VEHICLE

[76] Inventor: Kenneth W. Culotta, 1141 Willa Vista Trail, Maitland, Fla. 32751

[21] Appl. No.: 342,802

[22] Filed: Nov. 21, 1994

[51] Int. Cl.[6] ..... B63G 8/00

[52] U.S. Cl. ..... 114/315; 440/1; 440/6

[58] Field of Search ..... 114/315, 330; 405/185, 186; 440/1, 6; 180/9.22, 9.32

[56] References Cited

U.S. PATENT DOCUMENTS

| | | | |
|---|---|---|---|
| 3,916,814 | 11/1975 | Bardoni et al. | 114/315 |
| 4,051,846 | 10/1977 | McClure, III | 405/186 |
| 4,192,001 | 3/1980 | Villa | 364/418 |
| 4,843,998 | 4/1989 | Parker | 114/315 |
| 4,864,959 | 9/1989 | Takamizawa et al. | 114/315 |
| 5,292,269 | 3/1994 | Plost et al. | 440/6 |
| 5,365,868 | 11/1994 | Culotta | 114/315 |

*Primary Examiner*—Sherman Basinger

*Attorney, Agent, or Firm*—Julian C. Renfro

[57] ABSTRACT

A manually operable safety control for use by a diver utilizing an electric motor for propulsion, the safety control serving to automatically prevent an unsafe powered ascent of the diver. This novel safety control comprises a motor control operatively associated with the electric motor, with the safety control utilizing at least a portion of a dive computer interconnected with the motor control. The dive computer has a pressure sensitive device responsive to changes in depth and serving to calculate rate of change of depth, with the computer being operatively connected to the motor control. The motor control is deprived of electric power in the event of the diver ascending too rapidly. In accordance with one embodiment of my invention, the safety control may utilize only the ascent limiter, but another embodiment may also comprise at least one tilt activated switch interconnected with the motor control and serving to automatically prevent an unsafe horizontal operation of the vehicle. The tilt activated switch, upon the vehicle assuming an unsafe horizontal angularity, causes the motor control to deprive the propulsion motor of electric power.

14 Claims, 6 Drawing Sheets

228
VOLTAGE AMP
225
D TO A CONVERTER
COUNT BUS
211
MAX COUNT DETECTOR
217
CLK
UP/DN
PE
CI
MSD CNTR.
218
CO
CLK
UP/DN
PE
LSD CNTR
224
MIN COUNT DETECTOR
J
MAX COUNT
MIN COUNT
COUNTER DIRECTION FLIP FLOP
R
S
Q
D
216b
216
CLK
DIRECTION
ALL STOP
COUNT CLOCK
CONTROL VOLTAGE OUTPUT

+12V
211
217
218
224
225
226
227
228
229
230
231
A
B
C
D
E
F
EX
KD
KC
KB
KA
H
G
F
E
D
C
B
A
J
QA
QB
QC
QD
CO
CI
CLK
PE
B/D
U/D
DB0
DB1
DB2
DB3
DB4
DB5
DB6
DB7
VOUT SENSE SELECT
CS
CE
CONTROL OUTPUT

ALL STOP
A
B
MAXCOUNT
C
D
MINCOUNT
E
F
+12V
203
204
RC05
202
201
207
210
210a
210b
210c
216
216a
216b
206
205
209
214
213
215
208
212
ANALOG GND
PWR GND
-3V
+3V
200
+ INPUT FROM DIVE COMPUTER 1
- INPUT FROM DIVE COMPUTER 2
+12V SUPPLY VOLTAGE
221
TRIG OUT
RSET
DSCH
THRES
CON
223
222
219
220
CONTROL OUTPUT
232

MULTIFEATURE SAFETY MOTOR CONTROL FOR DIVER PROPULSION VEHICLE

RELATIONSHIP TO EARLIER INVENTION

This invention bears a distinct relationship to the invention set forth and claimed in my U.S. Pat. No. 5,365,868 entitled "Underwater Propulsion System Having Reduced Weight Penalty and Variable Angle of Thrust," which issued Nov. 22, 1994, and relevant parts of that invention are to be considered as incorporated by reference into the description of the instant invention.

BACKGROUND OF THE INVENTION

In the past, the primary safety control in a scuba diver's propulsion device, be it hand held or worn, has been a momentary type switch. Examples of this can be seen in the devices of Parker U.S. Pat. No. 4,843,998 and Bardoni et al U.S. Pat. No. 3,916,814, as well as the hand held device Takamizawa et al U.S. Pat. No. 4,864,959.

Momentary-type switches, also known as "dead-man" switches are utilized for this application because the switch is normally "open," with its contacts being apart. The scuba diver must "close" the switch by physically and continuously keeping the contacts together. However, for devices that are worn, this conscious effort restricts the use of one of the diver's hands.

A problem with some of the momentary-type switches commonly used is that they rely on some type of water tight seal such as an O-ring or rubber boot to prevent the unwanted intrusion of water from reaching the contacts. Unfortunately, these seals can easily fail.

A solution to this problem was recognized by Takamizawa et al with the use of a reed switch. The reed switch has its contacts hermetically sealed in a glass tube and functions when a magnet pulls its contacts together.

My safety control also uses a hermetically sealed switch but in the form of an opto-electronic device. This device is electrically operated and consists of an infra-red emitter and detector and has no moving parts. Therefore it can be potted into the case along with the rest of the electrical components and thus virtually eliminate the chance of water intrusion.

A movable gate, which does not have to be sealed, serves to function the device by coming between the emitter and detector. Two other opto-electronic devices act in the same manner to function the "power down" and "all stop." The "power up" optoelectronic device, which hereinafter shall be referred to as an ISO (isolation switch, optical), is powered by the same battery which is used in a highly novel safety feature of my control, the ascent limiter.

The novel ascent limiter in accordance with my invention utilizes a standard dive computer to interrupt the electrical power supplied to the propulsion motor should a safe ascent rate be exceeded. In this instance, a Marathon dive computer made by Orca Industries (U.S. Pat. No. 4,192,001) was used. Should the battery in the computer go dead, the ISO cannot start the "power up" function of the conventional electronic motor control. By way of example, a Minn Kota (Mankato, Minn.) motor control was used.

Furthermore, should the dive computer fail altogether, the control has a pitch angle limiter which, through the use of mercury switches, again interrupts the electrical power supplied to the propulsion motor. This occurs when a predetermined horizontal position for the scuba diver has been exceeded.

These safety features are very important because a scuba diver could seriously or fatally injure himself or herself if the propulsion device was operated in a careless manner.

SUMMARY OF THE INVENTION

In accordance with this invention I have provided a manually operable safety control for use by a diver utilizing an electric motor for propulsion. My novel safety control serves to automatically prevent an unsafe powered ascent of the diver, with this safety control comprising a motor control operatively associated with the electric motor. The safety control utilizes at least a portion of a dive computer interconnected with the motor control, which dive computer has a pressure sensitive device responsive to changes in depth and serving to calculate rate of change of depth. The computer is operatively associated with means connected to the motor control, latter means causing the motor control to deprive the propulsion motor of electric power in the event of the diver ascending too rapidly.

This system employs Digital Circuitry which provides for precise incremental control of propulsion speed. The use of CMOS technology minimizes power consumption.

Commands from the operator to change propulsion speed comes from the activator of either the UP or DOWN push buttons. When either the up or down switches are active, internal counters force a voltage change at the control output, which in turn supplies the control voltage for an external motor controller.

In the interest of safety, several safeguards have been incorporated into my novel speed control system:

1. In the event a diver would start to ascend too fast, an external input from a dive computer, designed to illuminate a lamp, sets internal counters to zero, forcing a "0" voltage output to the motor controller, and propulsion is then reduced to zero.
2. Activation of the "emergency stop switch" also forces a zero voltage output to the motor controller, propulsion is then reduced to zero.
3. Two tilt activated switches detect too steep of an angle either up and down, and when activated, forces a zero voltage output and propulsion is again reduced to zero.
4. Designed to be used in conjunction with a diver computer, positive propulsion is designed to occur only after the diver computer is turned on.

It is to be noted at the outset that the following startup conditions must be satisfied before the speed control circuitry will function properly:

1. The external dive computer must be powered and turned on.
2. The propulsion unit batteries are charged and the drive unit is turned on.
3. The external dive computer is not outputting a too rapid of ascent condition.
4. The emergency stop switch is not active.
5. Both of the tilt activated switches are not active.

It is therefore a primary object of this invention to provide a manually operable safety control for automatically preventing too rapid a powered ascent by the diver, which safety control has minimal moving parts.

It is another object of this invention to take advantage of inexpensive electronic design techniques for controlling ordinarily analog functions in a highly effective, ultra stable digital manner.

It is still another object of this invention to use a plurality of opto isolators as interface devices, which opto isolators offer much higher reliability than the mechanical switches customarily used in motor controls.

It is yet another object of this invention to provide a novel safety feature in which a pair of opto isolators serve as interface components when the dive computer battery is up to the proper power lever, but which will not serve the interface function when the battery is not properly up on power.

It is yet still another object of this invention to provide a manually operable safety control for automatically limiting to a safe operable pitch angle, the use of a diver's propulsion vehicle.

It is yet another object of this invention to provide an automatically functioning motor shutoff through the use of a pair of tilt activated switches, which automatically shut off the propulsion motor should the diver execute an unwise up or down maneuver.

It is yet another object of my invention to provide a safety control for a propulsion device to be used by a scuba diver, that cannot be easily circumvented, even by a deliberate action on the part of the diver.

It is yet another object of my invention to provide a highly advantageous computer control for a propulsion system used by a scuba diver, which computer control differs from prior art devices by not merely warning the diver of an unsafe condition, but rather automatically preventing the diver from misusing the equipment and utilizing the propulsion system when to do so is unsafe.

It is yet another object of my invention to provide a highly advantageous computer operated system control for a propulsion system used by a scuba diver, which control incorporates a pressure transducer sensitive to the depth at which the diver is operating, which transducer causes the speed control of the propulsion motor to reset the clock timers of the speed control should the ascent of the diver involve an unsafe rate.

It is yet another object of my invention to provide a highly advantageous computer operated system control for a propulsion system used by a scuba diver, which control utilizes regularly recurring timing signals serving to power up or power down the propulsion motor, depending upon the manner in which the diver manipulates a button array provided for his convenience.

These and other objects, features and advantages of this invention will be more apparent from a study of the appended drawings.

DETAILED DESCRIPTION

Figure 1:
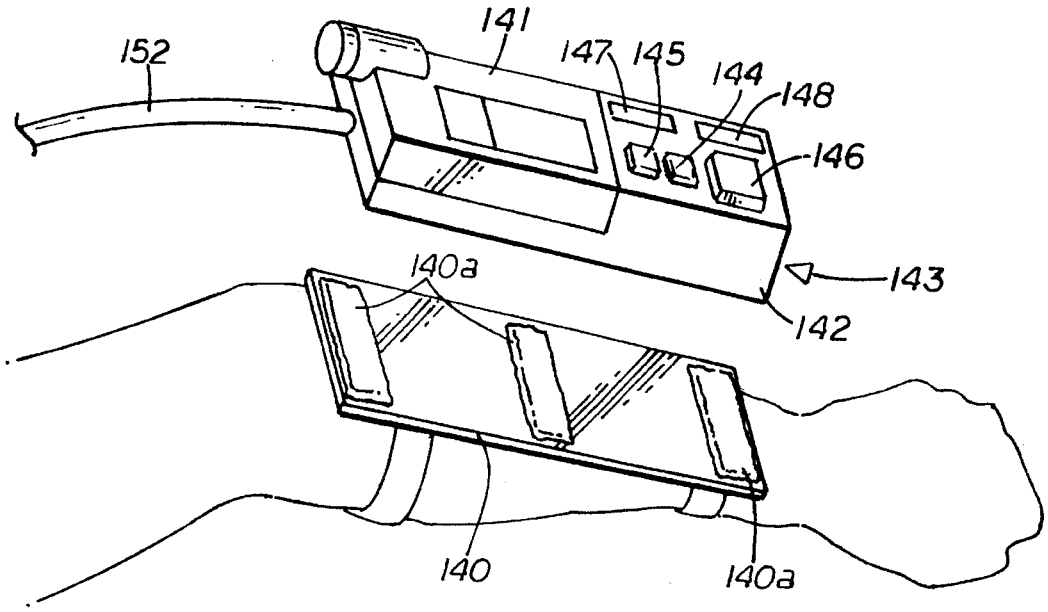
FIG. 1 is a illustration of an embodiment of my invention when involved with a propulsion device mounted on the back of a diver, this involving a forearm control making control buttons readily available for use by the diver, with this embodiment of my invention also containing the circuitry associated with my novel multifeature safety motor control to be used by a diver.

With initial reference to FIG. 1, it will be seen that I have illustrated my novel system controller 143 on a mounting pad 140 secured to the forearm of the diver, such as by the use of straps. Velcro strips **140*a* mounted on the pad 140 are arranged to receive the watertight system controller case 142, in which the system controller 143** is contained. Because of this arrangement, the controller can be readily removed from or applied to the diver's forearm.

In the event that a rescue should happen to be needed with regard to a diver using my novel system, the rescuer, though familiar with the buckles and straps associated with a BC (buoyancy compensator), may fail to recognize other equipment attached to the diver's forearm. Quite advantageously, my novel controller 143 can be expected to peel readily away from its Velcro mounting, thus allowing the rescue diver to jettison the injured diver's equipment should such become necessary.

Visible in FIG. 1 is the system control cable 152, which serves as an electrical connection between the system controller 143 and the motor control components located in the battery tube 36 utilized on my novel U.S. Pat. No. 5,365,868 entitled "Underwater Propulsion System Having Reduced Weight Penalty and Variable Angle of Thrust," which issued Nov. 22, 1994. Quite obviously, the motor control components could instead be located in the battery tube 38. The battery tubes 36 and 38 are shown in my above-identified patent but they are not illustrated in the drawings of the present case.

The system controller 143, which is contained inside the watertight case 142, involves the dive computer 141, the control buttons 144, 145 and 146, the motor speed indicator 147 and the battery power indicator 148. The electrical components of this novel device are potted into the case 142, to prevent the undesired intrusion of water, and the switches and buttons I use are hermetically sealed for the same reason.

The system controller 143 I prefer to use involves CMOS integrated circuits, with digital logic being utilized to control propulsion speed. I prefer this type of arrangement inasmuch as digital logic makes precise control readily possible, and CMOS circuitry reduces power drain on the battery.

As an indication of the arrangement I prefer to use, power is supplied from the battery, via the system control cable 152, to a free running IC clock located in the system controller 143, which IC clock supplies all timing and control pulses. Upon the diver actuating the "Up" button 145, or the "Down" button 144 shown in FIG. 1, the logic will be caused to output an increase or decrease of speed control to the motor control unit 170 which, as discussed hereinafter, is preferably located in battery tube 36. The control of the speed of the motor 20 is accomplished through "up-down" counters that feed digital data to a digital-to-analog converter. This IC will then convert the digital signal to an analog current, which is fed to a DC operational amplifier that in turn outputs a proportional DC voltage to the motor control 170.

As will be clear to those skilled in this art, upon the diver depressing the "Up" button 145, the propulsion motor 20 is caused to rotate and thus cause propeller 22 to rotate in the proper direction. Motor speed is caused to increase as long as the diver continuously depresses the button 145. The preferred arrangement is such that the diver can operate the propulsion motor at a selected speed less than full speed by removing his finger from button 145 at the appropriate time. It is to be understood that by maintaining pressure on the "Up" button 145, the diver can cause the motor speed to gradually increase until full speed is reached. In a converse manner, the motor speed can be caused to decrease gradually by keeping the "Down" button 144 depressed.

Continuing with a discussion of FIG. 1, for the convenience of the diver, motor speed is indicated by an LED bar graph display 147, and a similar display 148 indicates remaining battery power.

For safety reasons, I provide a button 146 at a convenient location on the case 142, which button can be operated should the diver need to suddenly disengage power from the motor 20, so that the propeller will stop rotating. It will be noted that this button 146 is significantly larger than the other buttons so that there can be no misunderstanding as to the position or function of this button. When the diver wishes to immediately shut off the propulsion motor 20, he need only momentarily depress the all-stop or motor cutoff button 146, which will have the direct effect of causing the motor 20 to stop rotating.

To later restart the motor, button 145 must be depressed again, with the diver, as before, maintaining pressure on this button until such time as the motor has attained the desired speed of rotation.

Figure 2:
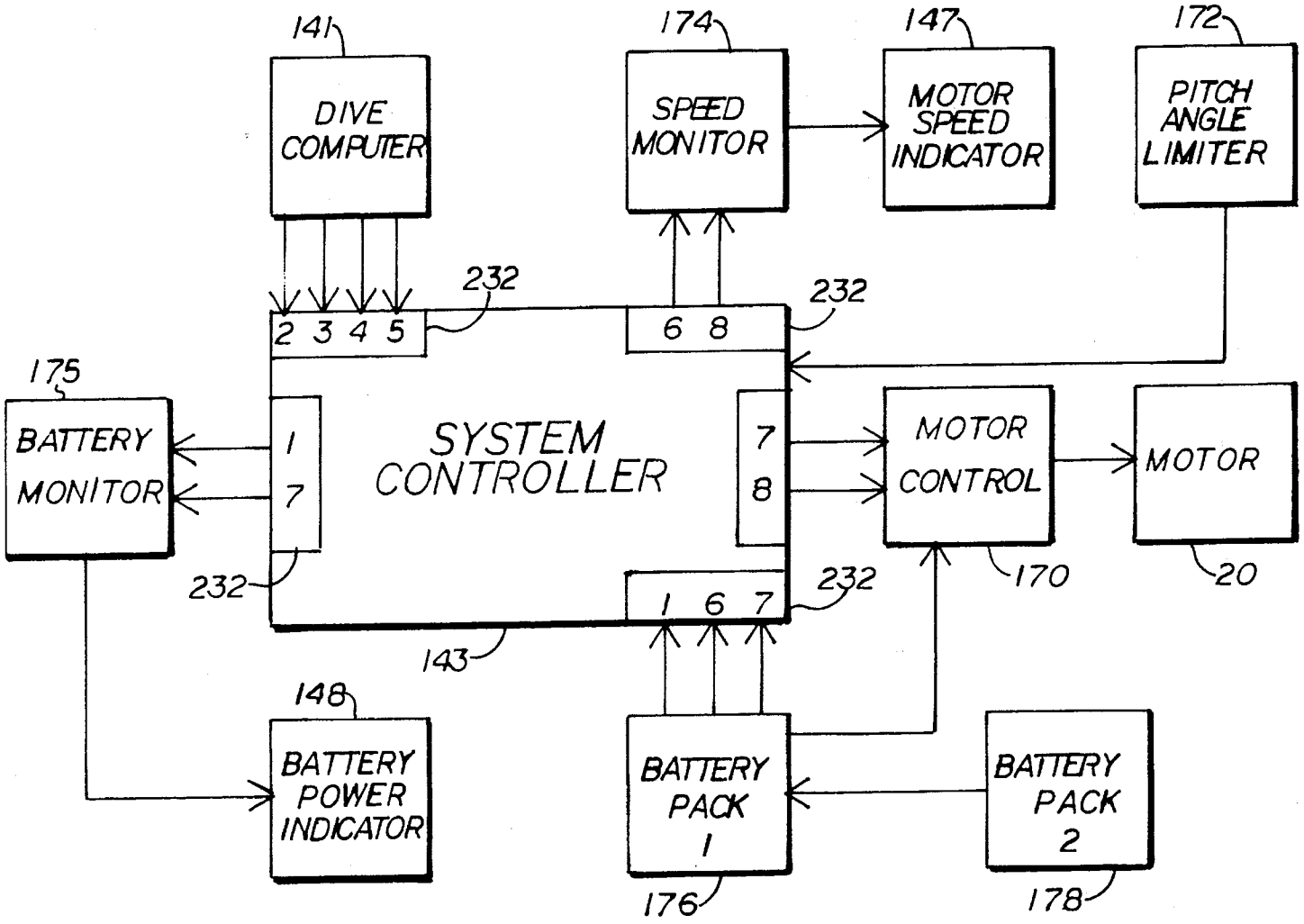
FIG. 2 is an overall block diagram of my improved multifeature safety motor control for a diver propulsion vehicle.

With reference now to FIG. 2, a block diagram of the electrical arrangement utilized in conjunction with this invention is set forth, including the system controller 143, the motor control 170, and certain devices associated with the safety of the diver. The physical location of the motor control 170 is preferably in one of the battery tubes, such as tube 36, as previously mentioned in conjunction with my U.S. Pat. No. 5,365,868. The motor control I prefer to use is of conventional construction, and I do not predicate any invention in its details. As an example, the motor control 170 may be made by Minn Kota, of Mankato, Minn. The motor 20 I use may also be made by this same company, but obviously I am not to be limited to this.

By its very nature, the motor control 170 may become quite warm in use, which might well have a deleterious effect on sensitive electronic components. Therefore, the manufacturer typically mounts components of this type on a finned heat sink, so that components of the motor control that become hot can dissipate such heat directly to the air. Because such a use of air cooling is not realistically possible in my utilization, I typically place the components of the motor control 170 likely to undertake a substantial rise in temperature in close physical contact with the metal cap 50*a*, located on the tube 36 as shown in FIGS. 1, 3 and 10 of my U.S. Pat. No. 5,365,868. This arrangement makes it readily possible for these components to be kept sufficiently cool by the surrounding water.

By now it should be clear that the system controller 143 secured to the diver's forearm serves to direct the output of the motor control 170, which in turn governs the power supplied by the battery pack 176 and the battery pack 178 to the motor 20. FIG. 2 reveals that the system controller 143 also directs inputs from the battery packs 176 and 178 to a battery monitor 175, located in the watertight case 142 removably secured to the diver's forearm. It will be noted from FIG. 2 that an interface connector 232 reveals the pin connections from the dive computer 141, the speed monitor 174, the motor control 170, the battery monitor 175, and the battery pack 176 to the system controller.

The battery monitor serves the function of displaying the battery condition on the battery power indicator 148, located in a conspicuous position on the case 142, such that it may be readily seen by the diver.

The motor control 170 outputs through the system controller 143 to the speed monitor 174, which in turn displays through the motor speed indicator 147 located in the case 142. Also located in the case 142 is the dive computer 141, which I also refer to as the ascent limiter. This is a major safety device that I prefer to be electrically interconnected with the system controller 143, and its function it is to continuously gauge the ascent rate of the diver, and to automatically disengage electric power from the motor if a predetermined safe ascent rate is exceeded. In other words, the ascent limiter or dive computer 141 prevents a powered ascent of such a nature as to cause injury or death to the diver.

The implementation of this ascent limiter I prefer to use for safety reasons may involve a commercially available dive computer. The device I prefer to use is a Marathon computer made by Orca industries (U.S. Pat. No. 4,192,001) interfaced to the motor control 170, but obviously I am not to be limited to this.

Normally a dive computer warns a diver of an unsafe ascent by giving some sort of signal. The Marathon computer accomplishes this by the use of a flashing light. Rather than having this light turn on, in accordance with my invention, the dive computer 141 instructs the controller to automatically disengage electric power from the motor in the event of an unsafe ascent rate. This is very important because while under power, the diver may inadvertently exceed his safe ascent rate due to his inability to accurately reference his path.

Another safety device in accordance with the instant invention is a pitch angle limiter 172, which is depicted in FIG. 2 and is located in one or the other of the battery tubes. This device prevents the motor 20 from operating should the pitch of the system exceed the negative and positive pitch angle limits. My device preferably utilizes mercury switches in order to achieve this goal, and by way of example, the motor is automatically deprived of power if the system deviates from the desired horizontal position by a significant amount.

As should now be clear, should either the dive computer 141 or the pitch angle limiter 172 deviate from the predetermined maximum settings, the system controller 143 automatically causes the motor control 170 to disengage electric power from the motor 20.

As an added functional safeguard, the circuitry of the system controller 143 is designed with a maximum and minimum speed loop block. This arrangement is utilized to prevent a clock pulse count reset to either maximum-to-minimum, or the inverse situation, either of which could cause personal injury to the diver, or else equipment damage.

It is to be understood that in accordance with the design of my novel speed control circuitry, I prefer to utilize opto isolators in four places. An opto isolator may be regarded as a LED and a phototransistor integrated into a single package sensitive to input voltage and generating light, thus causing conduction of the phototransistor. These opto isolators represent a highly effective interface arrangement preventing ground loops. Ground loops would have the unfortunate result of altering the circuit's function, and are thus to be avoided.

Two of these opto isolators are 208 and 213, which are the SPEED UP (Power Up) switch and the SPEED DOWN switch, respectively. A third opto isolator 204 serves the ALL STOP function, whereas a fourth opto isolator 200 is utilized in interfacing with Dive Computer 141.

Figure 3A:
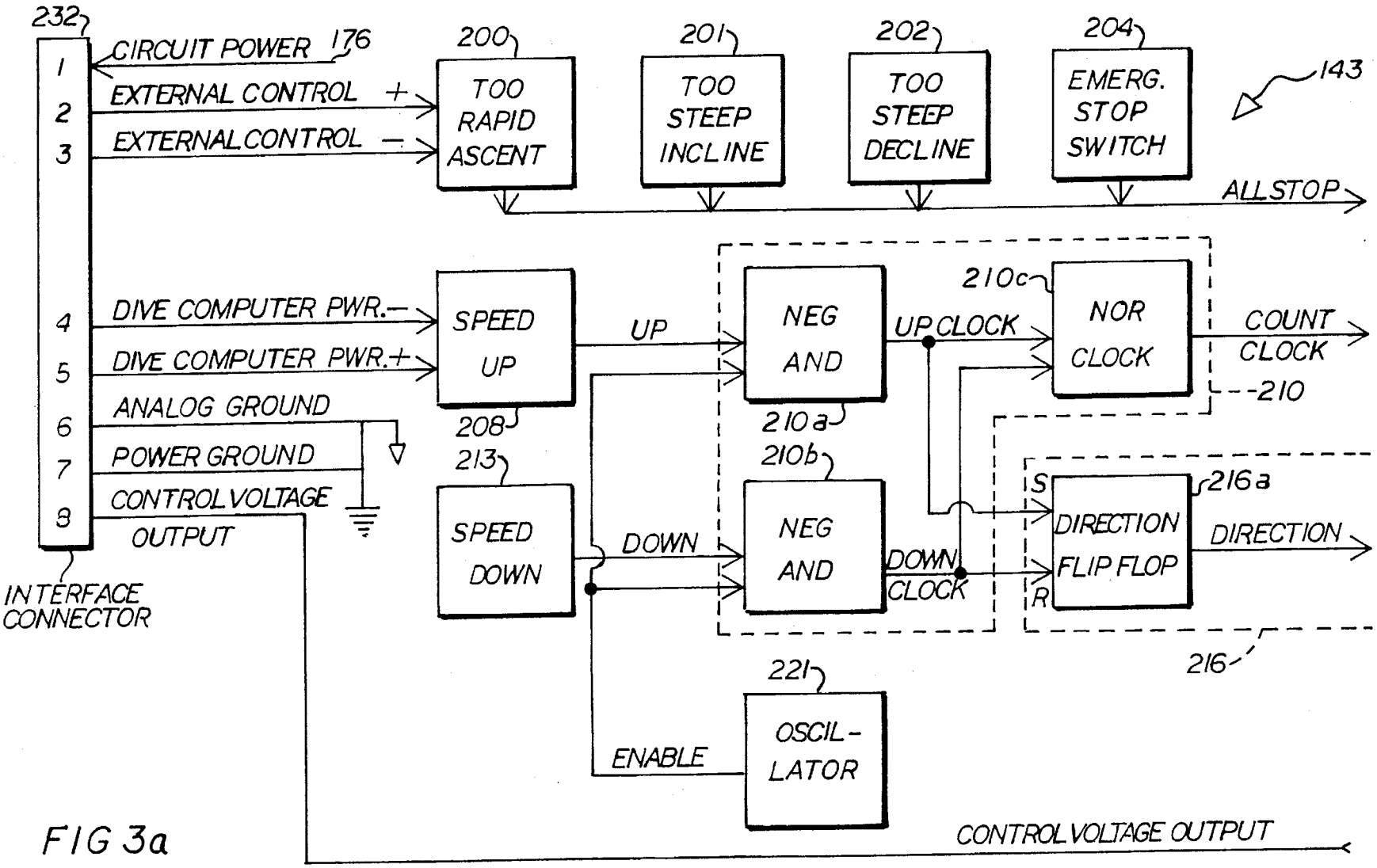
FIGS. 3A and 3B together represent a block diagram of my novel system controller.

It is to be noted on FIG. 3A that four components serve to provide an ALL STOP function, with three of these being of automatic operation, and a fourth being conveniently available to the diver, so that he can shut off the power to the motor should he or she wish the propulsive effort to cease.

The Too Rapid Ascent device 200, as mentioned hereinabove, is an opto electronic device interfaced to the dive computer 141, whereas the Too Steep Incline device 201 is an electromechanical switch. Similarly, the Too Steep Decline device 202 is also an electromechanical switch, and preferably both of these are mercury switches, but obviously I am not to be limited to this construction. The Emergency Stop Switch, as mentioned above, may be an opto electronic device, and this device is activated by the diver depressing button 144; see FIG. 1.

Figure 4:
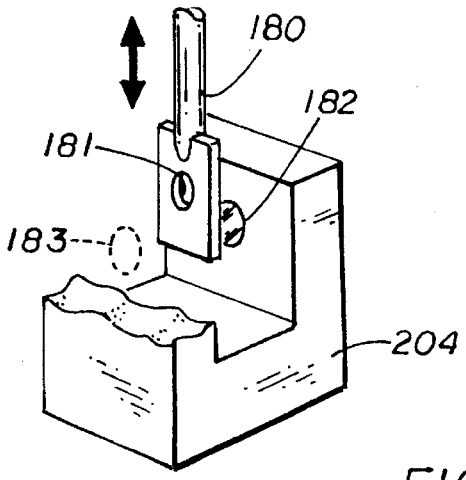
FIG. 4 is a fragmentary view, to a fairly large scale, of an opto isolator of the type utilized in several locations in the preferred implementation of my invention, with this view showing the location of the movable gate.

With regard to the buttons 144, 145 and 146, the pressing of any of these buttons causes a respective gate to move in a linear fashion with respect to an opto isolator. With reference to FIG. 4, in this figure I have shown opto isolator 204 as one example, which device involves a normally energized light source 182, and a detector 183 in substantial alignment therewith. Movable gate 180 is normally in a position interrupting this light beam, or in other words, represents a physical obstruction blocking the beam of light. However, upon the diver pressing the respective button downwardly, in this assumed instance, the Emergency Stop Button 146, this has the effect of causing the aperture 181 of gate 180 to move into alignment with respect to the light beam, permitting the light from the emitter 182 to reach the detector 183. This enables the detector to become active and to provide the selected ALL STOP function, in this assumed instance, the ALL STOP occasioned by the diver pressing the Emergency Stop button. The ALL STOP signal brings the control voltage output to zero, and thus causes a cessation of propulsive power.

Figure 3B:
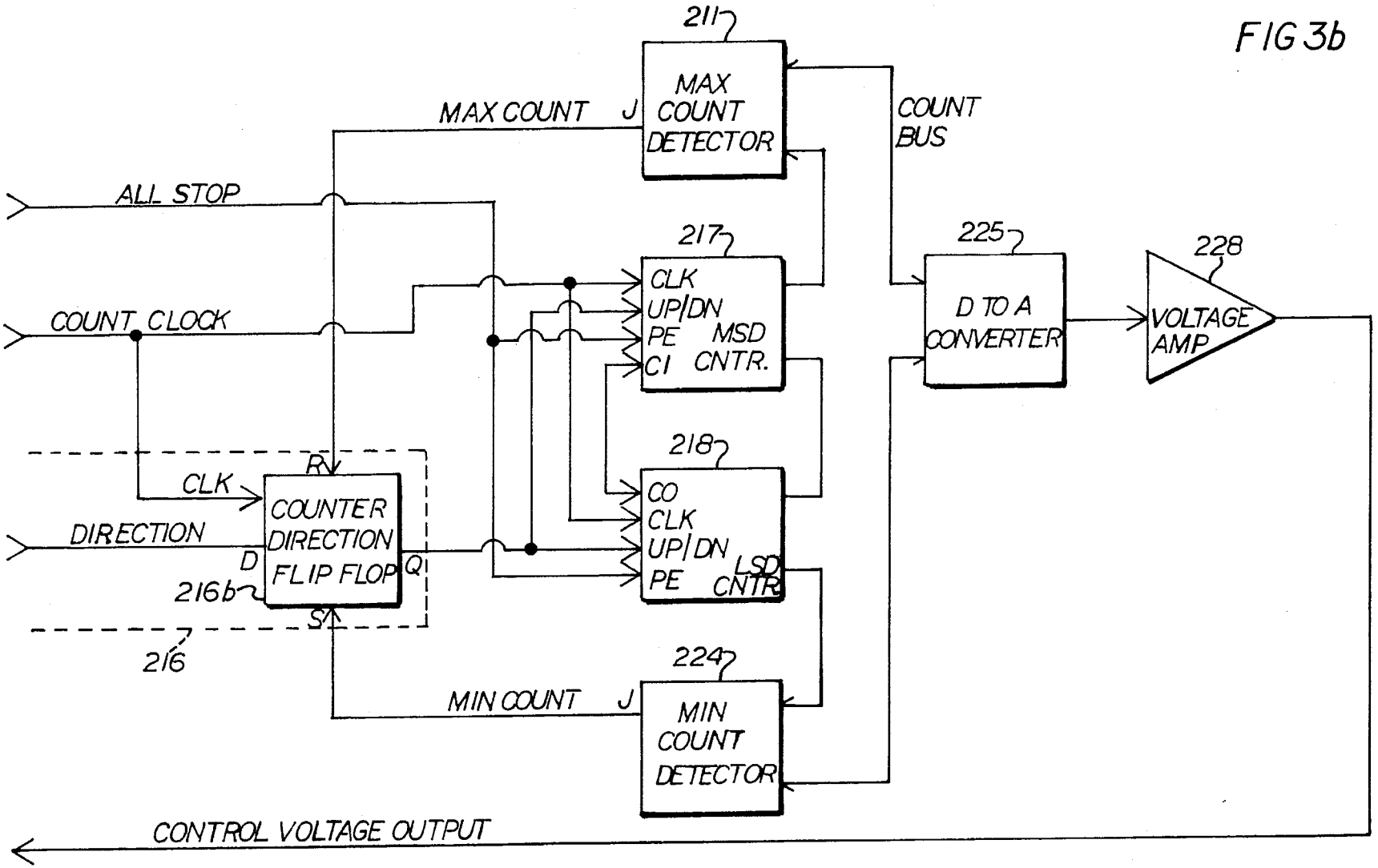

With reference now to related FIGS. 3A and 3B, it will be seen that I have shown my novel system controller 143 in considerable detail, with it to be understood that by placing the right hand edge of FIG. 3A alongside the left hand edge of FIG. 3B, the components of these combined figures can be viewed in the most easily understood relationship.

In FIG. 3A, circuit power is delivered from the diver's battery pack to the interface connector 232. Upon the application of power to the speed control circuit, oscillator 221, which may be a 555 Timer IC, outputs the dynamic timing signal necessary for incremental changes in propulsion thrust. I prefer to call this signal "ENABLE."

As will be apparent from FIG. 3A, ENABLE is applied to neg AND Gates 210A and 210B, which may be parts of a 4025 IC, with it to be understood that 210A & 210B are configured as a pair of two-input negative AND gates. The speed up switch 208 may be an HOA 1875-2 opto isolator, and upon the operator pressing the button 145, the neg AND Gate 210A will output a gated Enable signal UP CLOCK, equal in time to the length of the time that SPEED UP switch 208 is active.

Somewhat similar is the functioning of the SPEED DOWN switch, which is opto isolator 213, which may be a HOA1875-2. As long as switch 213 is active, as a consequence of the diver pressing down button 144, negative AND Gate 210B will output a gated Enable signal called DOWN CLOCK (DN).

As will be seen from FIG. 3A, UP CLOCK is fed to two places, with a first of these being one input of NOR CLOCK 210C, a 4025IC configured as a two input NOR gate. The second is the S input of direction flip-flop 216A, a 4013 IC configured as a set/reset flip-flop. DN Clock is also fed to two places. The first is the second input of NOR clock 210C, and the second is the R input of Direction flip-flop 216A.

NOR clock 210C serves as a multiplexer, thus providing COUNT CLOCK that is delivered to three places. As seen in FIG. 3B, the first is the CLK input of Counter Direction flip-flop 216B, which may be a 4013IC, a D type flip-flop. The second place is the CLK input of MSD counter 217, a 4029 IC 4 bit binary counter, whereas the third place is the CLK input of LSD counter 218, a 4029 IC, a 4-bit binary counter. COUNT CLOCK is the logically inverted signal of UP CLOCK, OR'ed with DN CLOCK.

Direction flip-flop 216A, visible in FIG. 3A, outputs a control signal called "DIRECTION." Direction will be in a Logic High state, upon the first transition of UP CLOCK from a Logic LOW to a Logic HIGH. Direction will stay at a Logic High state until the first transition of DN clock from a Logic Low to a Logic High state, at which time direction will change from a Logic High state to a Logic Low state. An example of this is when the diver pushes the Speed Up switch 208. It is to be understood that DIRECTION will be in a Logic High state when the operator wants to increase thrust, and in a Logic Low state when the operator wants to decrease thrust.

It will be seen from FIG. 3B that DIRECTION is fed to the D input of counter direction flip-flop 216B, a 4013 IC, which is a D-type flip-flop, and the current logic state of DIRECTION is latched on the next transition of COUNT CLOCK from a Logic Low to a Logic High. The output of Counter Direction flip-flop 216B goes to two places. The first is the UP/DN input of MSD counter 217, a 4029 IC, a 4 bit binary counter. The second is the UP/DN input of LSD counter 218, a 4029 IC, also a 4 bit binary counter.

The outputs of LSD counter 218 & MSD counter 217 form the COUNT BUS. COUNT BUS is a 8 bit binary coded number, which goes to three places. The first is Min Count Detector 224, a 4048IC configured to detect when the binary value of Count BUS is equal to the decimal number of "0." When COUNT BUS is equal to the number zero, the MIN COUNT from the J output of Min Count Detector 224 goes to the Logic High State, and is fed to the S input of counter direction flip-flop 216B. The MIN COUNT signal prevents Count BUS from being in a condition where the control voltage output of the speed control circuitry from changing instantly, from zero to full voltage. If this condition were to happen, propulsion would instantly change from OFF to maximum thrust, which would not be a desirable situation.

The second place where Count BUS goes is to MAX count detector 211, a 4048 IC configured to detect when the binary value of Count BUS is equal to the decimal number of 255. As will be obvious to those skilled in this art, 255 is the highest number an 8-bit binary bus can attain. When Count BUS is equal to the number 255, the J output of max count detector 211 goes to the Logic High state, and this Logic High is felt at the R input of counter direction flip-flop 216B. This signal is called MAX COUNT, and prevents COUNT BUS from changing instantly from MAX to MIN count. This condition would cause the Control Voltage Output to instantly go to zero and reduce propulsion thrust to zero. This, also, is an undesirable condition.

The third place to which Count Bus goes is to D to A converter 225, a AD558 IC. The D to A converter 225 outputs a voltage proportional to the number output on to the COUNT BUS. When COUNT BUS is equal to 0, the voltage out of D to A converter 225 will be near zero, then as the value of COUNT BUS increases, the voltage at the output of D to A converter 225 increases to the MAX COUNT, which of course is 255.

The output of the D to A converter 225 is felt at the input of Voltage Amplifier 228, a TL 321 IC. Voltage amplifier 228 outputs the CONTROL VOLTAGE, which is the Control Voltage output of speed control circuitry. Voltage amplifier 228 is a unity gain amplifier and is scaled to meet the control requirements of the External Motor Controller.

It has previously been mentioned that the ALL STOP Signal is utilized for bringing about a cessation of electric power delivered to the propulsion motor, and with regard to FIG. 3B, it is to be seen that the ALL STOP signal is applied to the PE input of MSD (Most Significant Digit) counter 217, and to the PE input of LSD (Least Significant Digit) counter 218. ALL STOP is a wire OR'ed signal and serves to reduce the number at COUNT BUS to zero, which forces the D to A converter 225 output to zero. This in turn forces the voltage amplifier 228 to produce a Zero Control Voltage Output, which in turn reduces propulsion thrust to zero, via external motor controller 170, appearing in FIG. 2.

When ALL STOP is at a Logic High level, MSD counter 217 and LSD counter 218 are configured to output the binary value of "0." When all stop is at a Logic Low level, MSD counter 217 and LSD counter 218 are configured to count in an incremental fashion either up or down. Normally ALL STOP is at a Logic Low level. Upon activation of TOO RAPID ASCENT 200, which is a 4N32 IC, ALL STOP goes to a Logic High state, forcing the Control Voltage Output to be "0," thus reducing propulsion thrust to zero.

The same process of reducing the propulsion thrust to zero occurs when TOO STEEP INCLINE SW1, A A1/2-4859 tilt activated switch 201 is active, and again when TOO STEEP DECLINE SW2, a A1/2-4859 tilt activated switch 202 is active, and again when Emergency Stop Switch IS03, HOA1875-2 opto-isolator is active.

Figure 5:
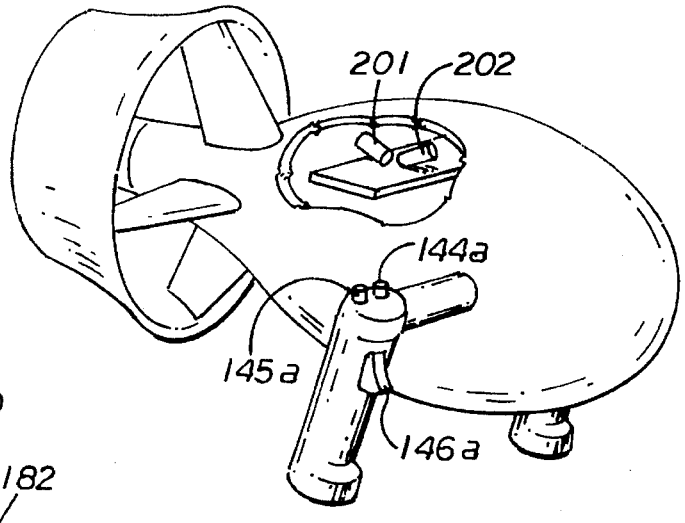
FIG. 5 is an illustration of another embodiment of my invention, this one involving a hand held underwater propulsion device in which control buttons are provided on the handgrips of the device, and in which the control components of my invention are located inside the hand held propulsion device; and FIGS. *6a* and *6b* together represent a schematic of my novel system controller.

With reference now to FIG. 5, a typical illustration of a hand held underwater propulsion vehicle or device is depicted, which vehicle is equipped with hand controls of a generally typical type. As will be noted from this figure, control buttons 144A, 145A and 146A are provided in conveniently reached locations, and function similarly to the buttons 144, 145 and 146, explained hereinabove with respect to the device generally shown in FIG. 1. An important exception to this is the button 146A depicted in FIG. 5, which is configured such that it must be continuously held in a depressed position in order for the diver to be able to operate the vehicle. In this sense, the switch 146A may be regarded as a "dead man switch."

Also shown in FIG. 5 is a typical location of the tilt activated switches 201 and 202, that serve to form the pitch angle limiter 172 and prevent the vehicle from being operated at an unsafe up angle or unsafe down angle, which might well jeopardize the safety of the diver. It will of course be recalled that in the previously described embodiment of this invention, the tilt activated switches 201 and 202 reside in the battery tube 36.

Figure 6B:
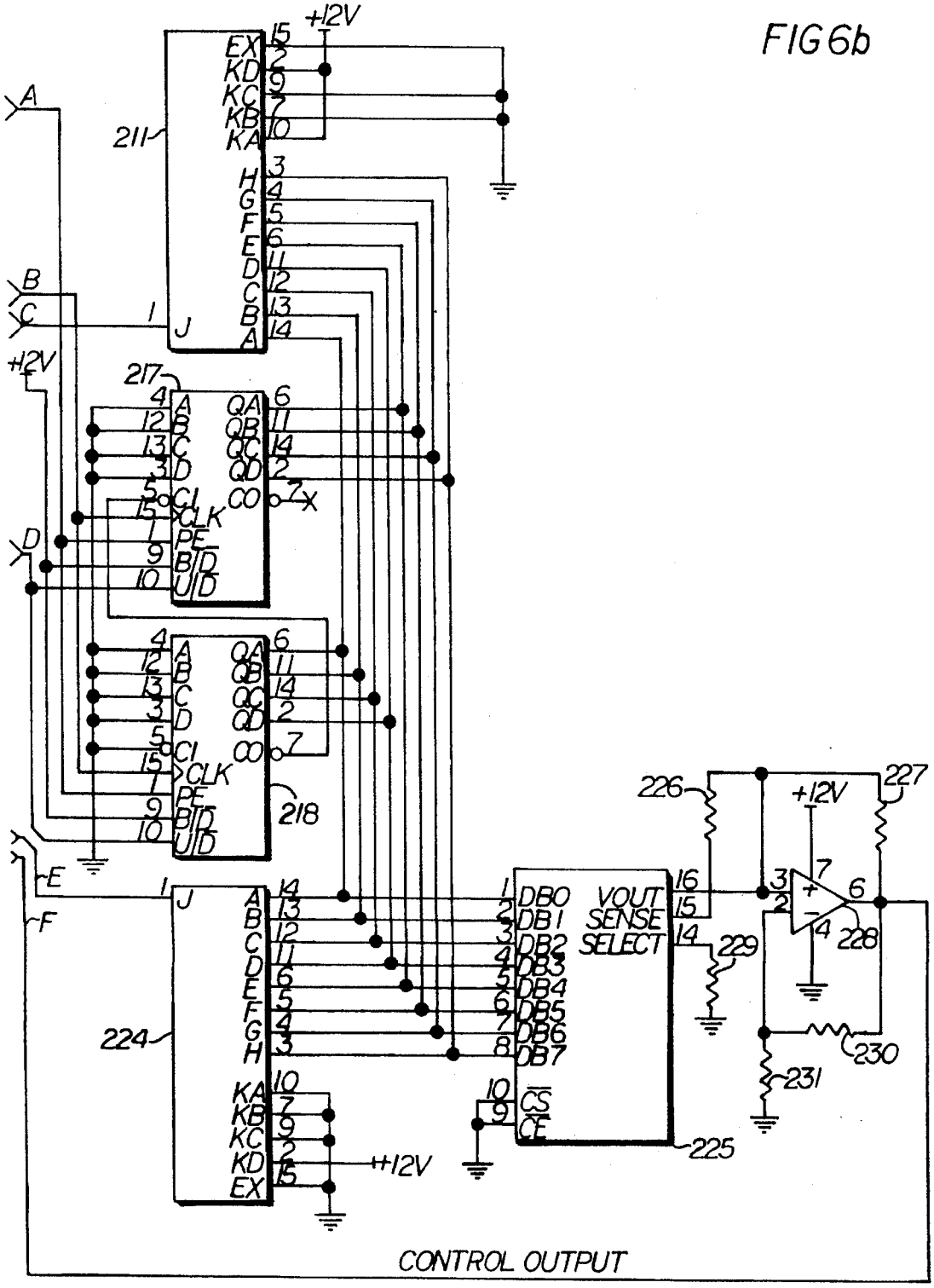
Figure 6A:
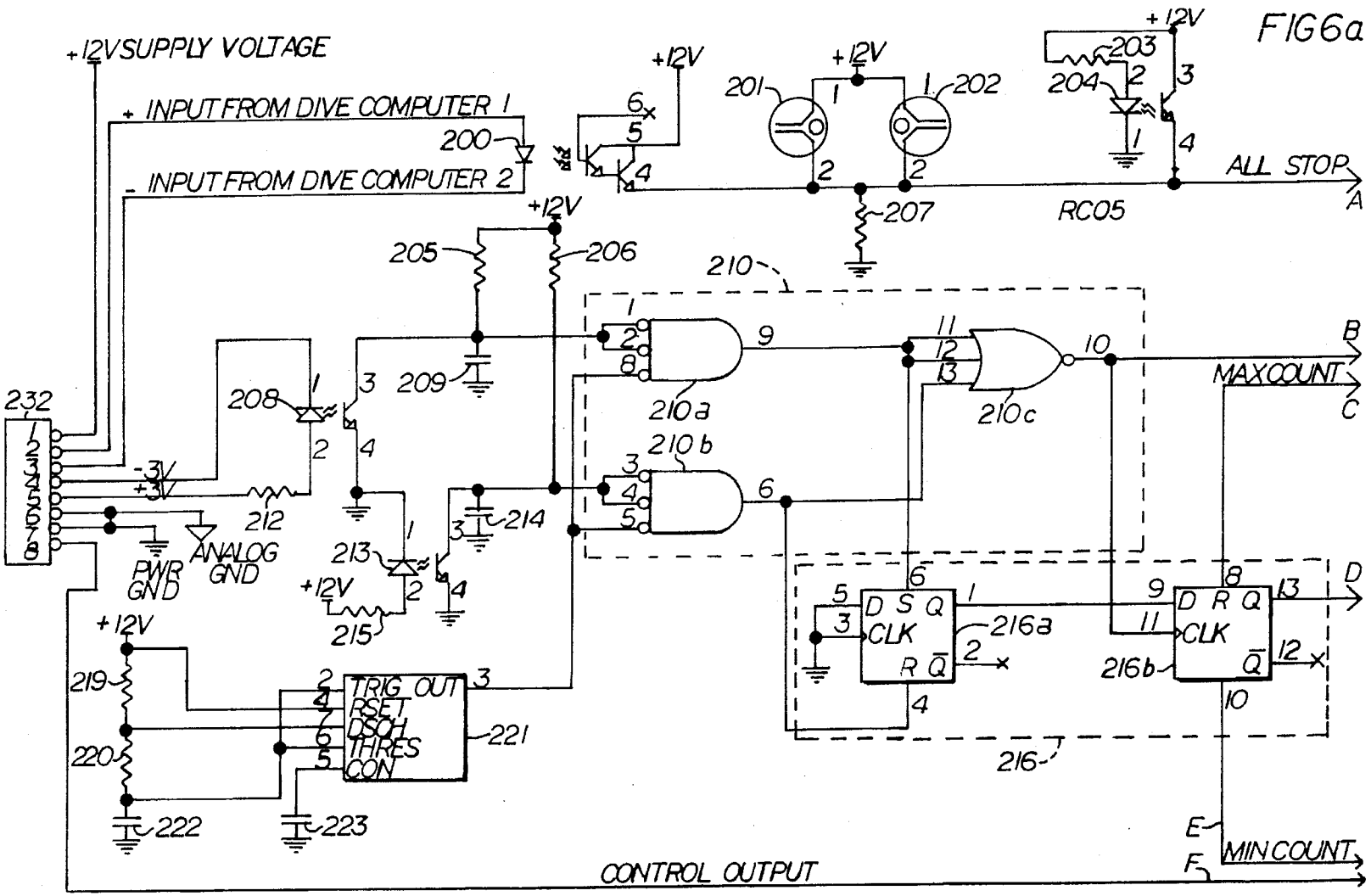

Turning to FIG. 6, it is to be seen that this figure is a schematic that bears a distinct relationship to the block diagram shown in FIGS. 3A and 3B.

Inasmuch as several reference numerals are used in the schematic that were not called out in the block diagram, it is to be pointed out that resistor 203 is a current limiter for the LED of opto isolator 204. Resistor 205, also a current limiter, serves the function of limiting the current for the transistor of opto isolator 208, whereas resistor 206 serves the same function for opto isolator 213.

Resistor 207 is a pull down resistor, insuring the logic low level of the ALL STOP signal, whereas 209 is a noise suppressor for opto isolator 208 when it is inactive.

Resistor 212 limits current flow through the LED of ISO 208, whereas 214 is a capacitor serving as a noise suppressor for ISO 213. Resistor 215 limits the current flow through the LED of ISO 213.

Resistors 219 and 220 in conjunction with capacitor 222 form an RC network which determines the frequency of oscillator 221, whereas capacitor 223 serves as a noise suppressor for oscillator 221. Components 226 and 227 are resistors that function to set the output gain of voltage amplifier 228. Component 229 is a pull down resistor used to stabilize the output gain of voltage amplifier 228 and set the output gain of the D-to-A converter 225.

Resistors 230 and 231 function to scale the gain of the voltage amplifier 228.

It will now be obvious to those skilled in this art that I have provided an affordable, manually operated safety control having a high degree of reliability and insuring to a marked degree, the safer operation of an underwater propulsion vehicle.

I claim:

1. A manually operable safety control for use by a diver utilizing an electric motor for propulsion, said safety control serving to automatically prevent an unsafe powered ascent of the diver, said safety control comprising a motor control operatively associated with said electric motor, said safety control utilizing at least a portion of a dive computer interconnected with said motor control, said dive computer having a pressure sensitive device responsive to changes in depth and serving to calculate rate of change of depth, said computer being operatively associated with means connected to said motor control, latter means causing said motor control to deprive said propulsion motor of electric power in the event of the diver ascending too rapidly.

2. The manually operable safety control for use by a diver as recited in claim 1 in which said propulsion motor is under the command of the diver.

3. The manually operable safety control for use by a diver as recited in claim 1 in which an emergency stop switch is provided to enable the diver to voluntarily cut off the power to said motor.

4. The manually operable safety control for use by a diver as recited in claim 1 in which said portion of said dive computer forms an ascent limiter.

5. The manually operable safety control for use by a diver as recited in claim 4 in which at least one opto isolator switch provides the interface between the electrical components of said motor control and said ascent limiter.

6. The manually operable safety control for use by a diver as recited in claim 1 in which a battery forms the source of power for said ascent limiter.

7. The manually operable safety control for use by a diver as recited in claim 6 in which at least one opto isolator switch provides a form of safety control by being non-functional unless the voltage of said battery is up to a minimal value.

8. A manually operable safety control for use by a diver utilizing a vehicle powered by an electric propulsion motor, said safety control serving to automatically prevent an unsafe horizontal operation of the vehicle, said safety control comprising a motor control operatively associated with said electric motor, said safety control utilizing at least one tilt activated switch interconnected with said motor control, said tilt activated switch, upon said vehicle assuming an unsafe horizontal angularity, causing said motor control to deprive said propulsion motor of electric power.

9. The manually operable safety control for use by a diver as recited in claim 8 in which an emergency stop switch is provided to enable the diver to voluntarily cut off the power to said motor.

10. The manually operable safety control for use by a diver as recited in claim 8 in which a battery forms the source of power for said propulsion motor.

11. The manually operable safety control for use by a diver as recited in claim 10 in which said propulsion motor is under the command of the diver.

12. A manually operable safety control for use by a diver utilizing a vehicle equipped with an electric motor for propulsion, said safety control serving to automatically prevent an-unsafe powered ascent of the diver, said safety control comprising a motor control operatively associated with said electric motor,.said safety control utilizing at least a portion of a dive computer interconnected with said motor control, said dive computer having a pressure sensitive device responsive to changes in depth and serving to calculate rate of change of depth, said computer being operatively associated with means connected to said motor control, latter means causing said motor control to deprive said propulsion motor of electric power in the event of the diver ascending too rapidly, said safety control also comprising at least one tilt activated switch interconnected with said motor control and serving to automatically prevent an unsafe horizontal operation of the vehicle, said tilt activated switch, upon said vehicle assuming an unsafe horizontal angularity, causing said motor control to deprive said propulsion motor of electric power.

13. The manually operable safety control for use by a diver as recited in claim 12 in which an emergency stop switch is provided to enable the diver to voluntarily cut off the power to said propulsion motor.

14. The manually operable safety control for use by a diver as recited in claim 12 in which a battery forms the source of power for said propulsion motor.

* * * * *